United States Patent [19]

Hurley

[11] Patent Number: 4,905,416

[45] Date of Patent: Mar. 6, 1990

[54] REVERSING WEIGHT ASSEMBLY FOR A VIBRATORY BOWL FINISHING MACHINE

[76] Inventor: Paul J. Hurley, 108 Park St., Reinbeck, Iowa 50669

[21] Appl. No.: 380,589

[22] Filed: Jul. 17, 1989

[51] Int. Cl.[4] ..... B24B 31/00

[52] U.S. Cl. ..... 51/163.1; 51/163.2

[58] Field of Search ..... 51/163.1, 163.2, 6, 51/7

[56] References Cited

U.S. PATENT DOCUMENTS

| | | | |
|---|---|---|---|
| 3,514,907 | 6/1970 | Strom | 51/163/ |
| 3,844,071 | 10/1974 | Barlett et al. | 259/72 |
| 4,329,817 | 5/1982 | Balz | 51/163.2 |
| 4,452,016 | 6/1984 | Majors | 51/163.2 |

*Primary Examiner*—Frederick R. Schmidt
*Assistant Examiner*—M. Rachuba
*Attorney, Agent, or Firm*—Zarley, McKee, Thomte, Voorhees & Sease

[57] ABSTRACT

An improved reversing weight assembly for a vibratory bowl finishing machine including a dampening housing attached to the upper end of drive shaft for the machine. The housing is filled with dampening material such as a viscous fluid and includes a freely rotatable dampening vane inside the housing. The vane is connectable to an upper eccentric weight which is rotatable in correspondence with rotation of the dampeing vane. Stop pins are adjustably positionable along the housing in association with the eccentric weight to limit its range of movement. Stop pins are positioned to determine the trailing angle for the top weight versus the bottom weight. Upon rotation of the drive shaft, the housing will correspondingly rotate, with the result being that the trailing stop pin will move into abutment with the top weight. The dampening vane, connected to the top weight, must be moved within the viscous fluid, thus dampening the force with which the top weight comes into abutment with the stop pins. Upon reversal, the weight will move to the opposite stop pins, but will be dampened by the viscous fluid.

4 Claims, 1 Drawing Sheet

REVERSING WEIGHT ASSEMBLY FOR A VIBRATORY BOWL FINISHING MACHINE

BACKGROUND OF THE INVENTION

1. Field of the Invention

The present invention relates to vibratory bowl finishing machines, and in particular, to an improvement in a reversing weight assembly for a vibratory bowl finishing machine.

2. Problems in the Art

Vibrating finishing machines or vibratory bowl finishing machines are well known in the art. They have been used for many years to deburr or finish manufactured parts.

A general discussion of such machines can be found at U.S. Pat. No. 4,329,817 which in turn cites numerous earlier patents involving vibratory finishing machines of this type. For purposes of this background, U.S. Pat. No. 4,329,817 is incorporated by reference.

It is crucial to an understanding of vibratory bowl finishing machines that the upper and lower eccentric weights control the action of the abrasive medium and parts being finished in the machine. The weights must be eccentric in the sense that the center of gravity of each weight is offset from the longitudinal axis of the drive shaft, but also these eccentric weights should have their center of gravity vertically offset from each other to impart desired vibratory motion in the machine.

Generally the eccentric weights consist of members which extend typically laterally from a line defining the rotational axis of the weights. There is therefore required an angular offset between the radial direction of the top eccentric weight from the rotational axis versus the radial direction of the lower eccentric weight from the rotational axis.

This offset determines both the volatility of action set up in the finishing machine, as well as the speed of movement of the machine and the items in the bowl of the machine. For purposes of this description, these factors will be designated in terms of the aggressiveness and speed produced by the machine.

The vibratory bowl finishing machine can be operated in two modes. The first will be referred to as the work mode where the products to be finished are introduced into the medium, and the machine is operated to cause deburring and finishing of the products. The vibrations generated by the offset eccentric weights contribute to a "scrolling" type motion of the mixture in the bowl; that is, a constantly turning over of that mixture, along with a circular slightly vertical amplitude. By utilizing a bowl, the contents of the bowl can be kept in a continual controlled but churning and circulating motion.

The direction of motion is also determined by the position of offset of the eccentric weights. The bottom weight is referred to as the leading weight. The bottom weight is angularly offset to lead the top weight. Of course, denomination of leading versus trailing depends on the direction of rotation of the drive axle. The bottom eccentric weight should always lead the top weight in the direction of rotation of the drive axle.

It is therefore to be understood that positioning the weights determine at least the aggressiveness of the mixture in the bowl and the speed of the mixture in the bowl, as well as the direction of movement of the mixture in the bowl.

Adjustment of the angular offset of the eccentric weights to change these parameters has been recognized in the prior art, as is discussed in the patent incorporated by reference above. It was further recognized that to facilitate easier separation of the parts from the abrasive media after finishing, methods could be developed to reverse the direction of movement of the mixture in the bowl. One way was to insert a ramp (or what in the art is called a dam) into the bowl and utilize the vibratory motion of the machine to cause the generally heavier finished parts to travel up the dam to an outlet container while keeping the abrasive medium within the bowl.

Output ramps or screens are well known in the art such as are discussed in U.S. Pat. Nos. 4,329,817, and 3,844,071.

It therefore became a need to allow the eccentric weights to be generally reversed in their angular relationships when their direction of rotation is reversed, so that a reversal in direction of movement of the mixture in the bowl could be accomplished. Originally, this was accomplished by simply unfastening at least one of the eccentric weights (usually just one), rotating it to the desired opposite angle, and then tightening it down on the drive shaft again. While fundamentally this was satisfactory for the operation of the machine, it was wasteful of time and resources to require such change upon every reversal of the machine.

Other attempts included using adjustable eccentric weights, which could be more easily fixed into a variety of different angles. This still, however, required the machine to be stopped, the weights changed in angle, and then restarted upon each reversal of the machine.

Recent U.S. Pat. No. 4,452,016, discloses an automatic reversing weight for a vibrating finishing machine. To avoid the manual reorientation of one or more of the eccentric weights on the drive shaft, the top eccentric weight is replaced by a canister having radial dividing baffles at preselected angles. Steel shot of size and weight to cumulatively simulate the weight of an eccentric weight, is positioned inside the canister. When the drive shaft is rotated in one direction, the shot by centrifugal force is thrown to the edge of the canister and against one of the baffles which is positioned so that the shot acts as the eccentric weight at the desired trailing angle from the lower eccentric weight. When reversal is needed, the drive shaft is simply reversed and the steel shot travels by centrifugal force along the inside perimeter of the canister up against the other angled baffle which represents the desired trailing angle for reverse direction for the machine. The U.S. Pat. No. 3,844,071 also reveals an automatically reversing eccentric weight which reverses on detection of changes in motor speed by somewhat similarly transferring the position of weighted balls on the basis of centrifugal force according to direction of rotation of the motor shaft.

The U.S. Pat. No. 3,844,071 also discloses an automatically operating ramp or screen. During the finishing mode of the machine, the screen hingeably rides on top of the mixture in the bowl. However, when direction is reversed, the screen is caused to tilt downwardly to the bottom of the bowl to allow migration of the mixture upwardly.

Although advances have been made in the vibratory bowl finishing machine art, room for improvement still exists. The prior art is deficient in that it still does not allow easy adjustment of the angular offset of the eccentric weights when characteristics of operation of the machine are desired to be changed. As previously stated, change in the offset of the weights will affect aggressiveness and speed of the finishing process. The automatic reversing weight vibratory finishing machines simply do not have an easy, efficient, durable way of adjusting the offset or trailing angle of the top weight.

Furthermore, the current automatic reversing weight machines experience significant wear and tear from the force of the steel shot or weighted balls being thrown in reverse directions by centrifugal force upon reversal of the machine. To reduce such wear, many times this requires complete stoppage of the machine, waiting a time period, and then slowly beginning the reverse process. Alternatively, the reversal can be so violent as to damage or break the machine.

There is therefore a real need in the art to provide an improved reversing weight assembly for a vibratory bowl finishing machine which improves over or solves the problems and deficiencies in the art.

Another object of the present invention is to provide an assembly as above described which automatically allows for reversal of the top weight of the machine, yet allows quick and easy adjustment of the offset or trailing angle in either direction for the top weight as compared to the bottom weight.

A still further object of the present invention is to provide an assembly as above described which presents dampening of the automatic transfer of the position of the top weight upon reversal of the machine.

A further object of the present invention is to provide an assembly as above described which is economical, efficient, and durable.

These and other objects, features and advantages of the present invention will become more apparent with reference to the accompanying specification and claims.

SUMMARY OF THE INVENTION

The present invention improves over conventional vibratory bowl finishing machines by allowing automatic reversal of the top eccentric weight, easy and efficient adjustment of the trailing angle of the top eccentric weight in any direction, and dampening of the shifted position of the eccentric weight upon reversal of the machine.

The upper end of the drive shaft of the conventional vibratory bowl finishing machine is replaced with a reversing weight assembly to accomplish the ends and objects of the invention. A housing having an enclosed inner cavity is securable to the top end of the drive shaft so that it rotates directly with the drive shaft. The drive shaft has at its lower end a bottom eccentric weight.

A top eccentric weight is rotatably positioned on the exterior of the housing, preferably resting on or closely adjacent to the top of the housing. The top weight is rotatable around a rotational axis which is defined by a connecting member between the top weight and a dampening vane positioned inside of the housing. The housing cavity is filled with a dampening material such as a viscous fluid. The vane is likewise rotatable within the housing, but such rotation is dampened by the fluid.

On the exterior of the housing, in association with the top weight, are adjustably positionable end stop means. The end stop means define the limit of rotation of the top weight in relation to the housing itself.

Therefore, the housing rotates in direct accordance with the rotation of the drive shaft. When the drive shaft is rotated in one direction, the housing will rotate in kind, causing the trailing end stop to move to, contact, and remain against the top weight. Without dampening fluid or the dampening vane in the housing, the end stop would impact into the top weight with substantial speed and force. This force could damage or even shear off an end stop, especially after many reversals. The dampening fluid and vane slow or dampen the movement of the end stop against the top weight. This actually results in the top weight moving slowly into contact with the trailing end stop in response to the rotation of the drive shaft, in a sense allowing the trailing end stop to "catch up" to the top weight. Instead of freely impacting between end stops, the top weight must force the vane through the fluid toward a stop pin at a much slower rate and with a dampened effect resulting in an acceptable impact force between top weight and end stop or stop pin. Once the top weight is against the end stop, the top weight will then rotate in frequency with the rotation of the drive shaft.

Upon reversal of the drive shafts, however, the dampening fluid will absorb much of the shock and force occurring on reversal of the entire assembly, and in a somewhat delayed fashion allow the top weight to pivot or rotate in a reverse direction until it abuts an opposite stop means. Thus, automatic reversing of the top weight is accomplished. It is also accomplished with shock absorption of the change by the dampening system.

The stop means are positionable along the housing so that the trailing angle in either direction rotation can be easily set and adjusted. One example of stop means would be pins which would be insertable into a plurality of apertures in the housing to allow selection of various trailing angles for either the forward or reverse direction of rotation.

DETAILED DESCRIPTION OF THE PREFERRED EMBODIMENT

Figure 1:
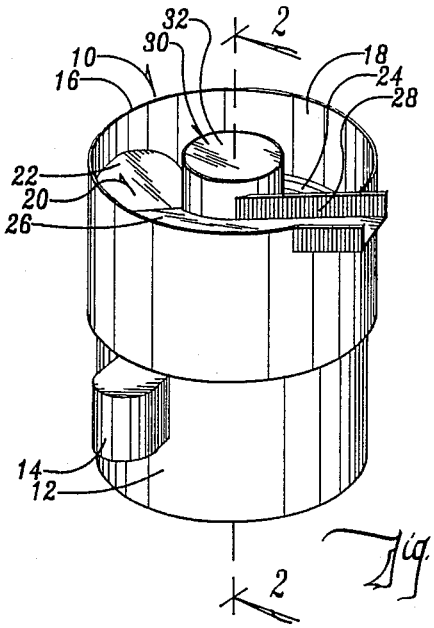
FIG. 1 is a perspective view of a vibratory bowl finishing machine with an improved reversing weight assembly and an automatically functioning parts separation ramp or dam.

With reference to the drawings, a preferred embodiment of the present invention will now be described. It is to be understood that this description is to aid in an understanding of the invention, but does not limit the scope thereof, which is defined by the claims set forth hereafter.

Reference numerals are utilized to indicate parts and features of the preferred embodiment shown in the drawings. Like reference numerals will be utilized to indicate like parts and features throughout all of the drawings.

In particular reference to FIG. 1, a vibratory bowl finishing machine 10 is depicted. Machine 10 includes a base 12 which encloses a motor 14. A vibratory bowl 16 is mounted to base 12 by resilient means such as springs 34 or the like (see FIG. 2).

The interior 18 of bowl 16 receives both abrasive media for deburring and finishing, and the parts themselves to be deburred and finished. In the embodiment of FIG. 1, there is shown a paddle-like grid, ramp, or screen 20 (alternatively called a dam) which pivotally moves between a first position where its extended end 22 drops to the floor 24 of bowl 16 and is angled upwardly to the separation or upper deck or screen 26 which in turn is connected to the output chute 28. Dam 20, deck 26, and output chute 28 all function as is well known in the art. Dam 20 is a freely floating member which travels on top of mixture in the bowl when in a deburring and finishing work mode, but is forced pivotally downward when the machine 10 is reversed for an unloading mode to allow the removal of the finished parts. It is to be understood that dam 20 and deck 26 can have holes or be screens which support the finished parts, but cause the abrasive media to fall back into the bowl and disallow the media from exiting through output chute 28.

FIG. 1 also shows the position of reversing weight assembly 30. A cover 32 is positioned over assembly 30 to segregate it from the mixture within bowl 16.

Figure 2:
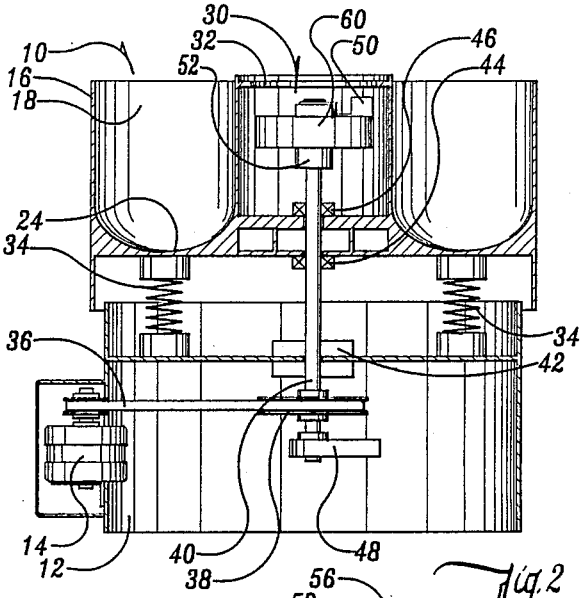
FIG. 2 is a sectional view taken along lines 2—2 of FIG. 1.

FIG. 2 depicts in more detail the components of machine 10. The outline of bowl 16 can be seen in cross section. The curved floor 24 of bowl 16 facilitates and enhances the scrolling and migrating movement of the mixture within the bowl during operation of machine 10.

Springs 34 connect bowl 16 with base 12. Motor 14 is connected by belt 36 to pulley 38 on vertical shaft 40. Vertical shaft 40 is in turn mounted within bearing 42 attached to base 12, and bearings 44 and 46 which are attached to bowl 16.

Motor 14 is reversable and can therefore rotate vertical shaft 40 in both rotational directions within bearings 42, 44, and 46.

Machine 10 functions by having a bottom eccentric weight 48 rigidly affixed to vertical shaft 40, and having a top eccentric weight 50 which rotates in response to rotation of the vertical shaft 40. The eccentricity of weights 48 and 50 set up vibrational forces in vertical shaft 40, which are in turn transmitted through bearings 44 and 46 to bowl 16. Because bowl 16 is resiliently mounted to base 12, the vibrations are amplified and concentrated to the vibratory bowl 16. The bottom weight 48 always "leads" top weight 50.

As has been previously described, the magnitude and speed of vibrations upon any mixture in the bowl 16 is determined by the speed of rotation of shaft 40, and the characteristics of eccentric weights 48 and 50. The larger the weights and the greater the offset from the rotational axis of shaft 40, the more violent or aggressive the vibrational force is transferred to bowl 16.

Additionally, if the top and bottom weights are offset in their center of gravity laterally from the rotational axis line defined by vertical shaft 40, so that the angular extended orientation of one weight is offset from the other, different predictable characteristics with regard to vibrations in bowl 16 can be set up.

FIG. 2 shows that in the preferred embodiment, reversing weight assembly 30 is attached by a collar means 52 to the upper end of vertical shaft 40. Assembly 30 therefore rotates in direct correspondence with the rotation of vertical shaft 40.

However, top eccentric weight 50 is connected by arm 54 to an upper shaft 56 which is rotatably journaled in bushing 58 of assembly 30. (See FIGS. 4 and 6).

A dampener housing 60, cylindrical in shape having a top plate 62, bottom plate 64, and a circular enclosing sidewall 66, encloses the dampening means of preferred embodiment of the invention. (See FIGS. 4 and 6).

Figure 3:
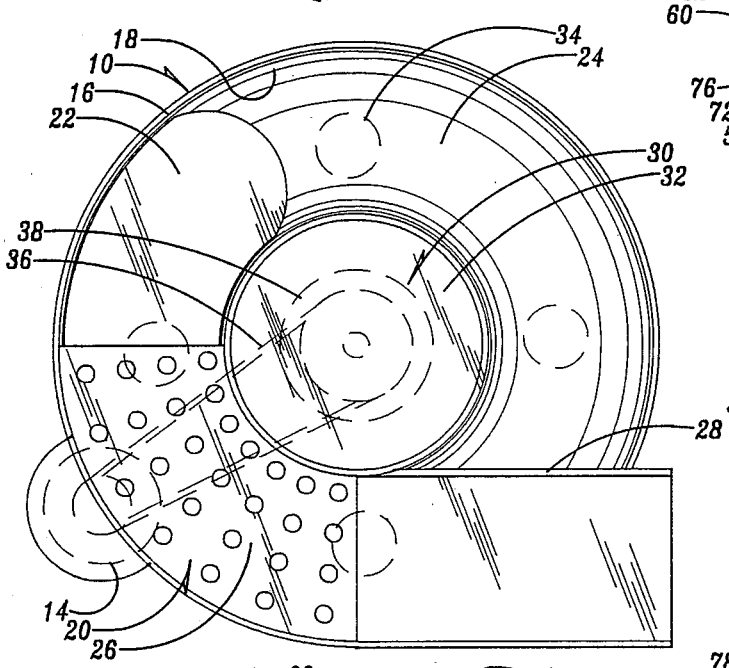
FIG. 3 is a top plan view of FIG. 1.

FIG. 3 shows in better detail the cooperation of the vibratory bowl 16, dam 20, separation deck 26, and output chute 28. It also shows the relationship between motor 14, pulley 38, and vertical shaft 40, as well as the positioning of the four springs 34.

Figure 4:
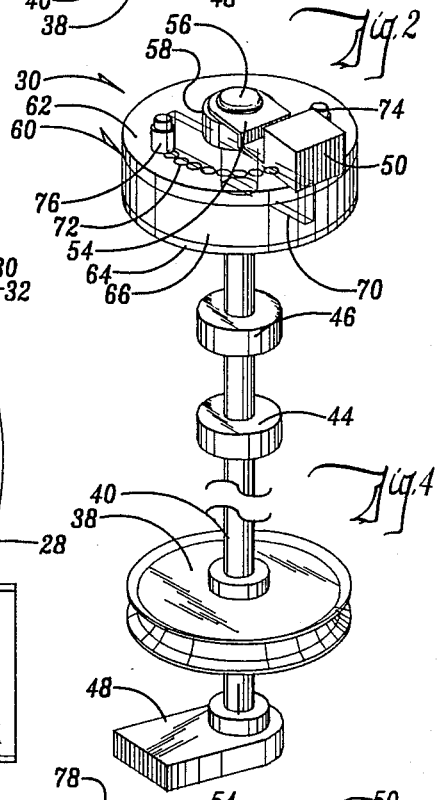
FIG. 4 is an isolated perspective view of the drive shaft, lower eccentric weight, and reversing weight assembly according to a preferred embodiment of the present invention.

FIG. 4, shows in an isolated fashion, the elements associated with vertical drive shaft 40 and reversing weight assembly 30.

In particular, FIG. 4 shows the connection of top eccentric weight 50 and arm 54 to upper shaft 56. FIG. 4 also shows that upper shaft 56 extends through bushing 58 into the interior cavity 68 (see particularly FIG. 6) of dampener housing 60, generally along a rotational axis line defined by vertical shaft 40. The lower end of upper shaft 56, which extends into cavity 68, has mounted to it a dampening vane 70 which is rotatable within cavity 68.

Vane 70 in the preferred embodiment is generally a rectangular bar having perimetric dimensions slightly smaller than the inside diameter and inside height of cavity 68.

Cavity 68 is filled with dampening material, which in the preferred embodiment is a fluid. It is to be understood that the viscosity of the fluid can be chosen to desire for selected dampening effect. For example, oil would have a much different dampening effect than water. Viscosity of the fluid is selected by considering factors such as the dampening effect desired, the method by which motor 14 reverses, and the start up torque of motor 14.

FIG. 4 also shows apertures 72 which are distributed in an arcuate adjacent series on top plate 62 of housing 60 between bushing 58 and perimeter edge of top plate 62. Stop pins 74 and 76 are adjustably positionable according to desire in aperatures 72 to set the range of pivotal motion of top eccentric weight 50 in relation to top plate 62 of housing 60.

In FIG. 4, stop pins 74 and 76 are placed at opposite ends of the arcuate series of apertures 72 to present the widest range of movement for top weight 50. Either or both pins 74 and 76 could be moved inwardly to change that range of movement.

As has been previously explained, placement of stop pins 74 and 76 determines the trailing angle for top eccentric weight 50 with respect to the bottom eccentric weight 48 for both directions of rotation of vertical shaft 40. For example, in FIG. 4, top eccentric weight 50 is in abutment with stop pin 74. When vertical shaft 40 and housing 60 are rotating in a clockwise direction, trailing stop pin 74 moves against top weight 50. Dampening vane 70 and fluid within cavity 68 of housing 60 dampen or substantially reduce the speed and force of contact between stop pin 74 and top weight 50. Top weight 50 will remain in that position as long as clockwise rotation continues. Thus, stop pin 74 will be set at a desired position to produce the desired trailing angle of top weight 50 for that direction of rotation.

Alternatively, if vertical shaft 40 is reversed to rotate counterclockwise, it would likewise cause housing 60 to rotate counterclockwise. Stop pin 76, now the trailing stop pin, will rotate to and contact the side of top weight 50 opposite from the side abutting stop pin 74 in FIG. 5. The dampening vane 70 and fluid in housing 60 will likewise dampen or substantially reduce the speed or force at which stop pin 76 and top weight 50 contact one another, as compared to the situation where top weight 50 was freely rotatable without the dampening action of vane 70 and the fluid.

The impact of top weight 50 and stop pins 74 or 76 is therefore controlled to an acceptable level, while still allowing full and normal operation of the vibratory finishing bowl machine. Stop pin 76 would be positioned at the desired location to set up a desired trailing angle for counterclockwise rotation.

Therefore, reversal of the trailing angle for top weight 50 for different directions of rotation will be automatically accomplished, yet it will be accomplished with elimination of banging of the top weight 50 from stop pin to stop pin. The dampening means of reversing weight assembly 30 eliminates this problem. Additionally, direct and easy adjustments of trailing angles for top weight 50 can be made by convenient and quick adjusting stop pins 74 and/or 76.

Figure 5:
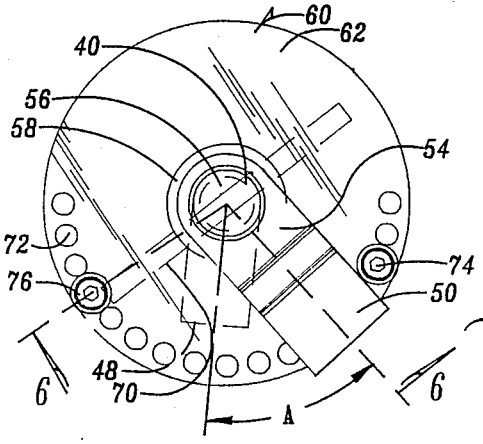
FIG. 5 is a top plan view of FIG. 4.

FIG. 5 shows an alternate view of top eccentric weight 50, and stop pins 74 and 76. Bottom eccentric weight 48 is also shown in ghost lines to better define what is meant by the "leading angle" between top and bottom weights 50 and 48. Angle A generally defines this leading angle, which in the case shown in FIG. 5, as in FIG. 4, would be for clockwise rotation of shaft 40 and housing 60.

Figure 6:
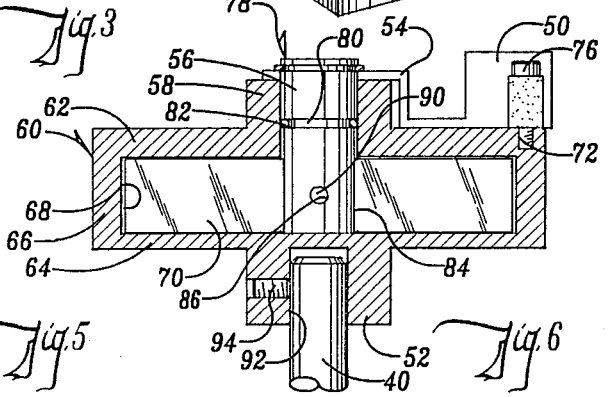
FIG. 6 is a sectional view taken along lines 6—6 of FIG. 5.

FIG. 6 shows in sectional form, the specific structure of the preferred embodiment of reversing weight assembly 30. Upper shaft 56, has connection means 78 for connecting arm 54 of top eccentric weight 50 to shaft 56. A groove 80 extends circumferentially around shaft 56 at an intermediate portion between opposite ends, and retains a sealing ring 82. A slot extends from the lower end of upper shaft 56 inwardly and upwardly to receive dampening vane 70. A transverse bore 86 in upper shaft 56 is aligned with an aperture 88 (not shown) in vane 70, both of which receive a locking pin 90 to connect vane 70 to upper shaft 56.

In the preferred embodiment, vertical shaft 40 is rigidly connected to reversing weight assembly 30 by being seated in channel 92, and being locked into place by locking screw 94.

It can therefore be seen that the present invention achieves at least all of its stated objectives. It will be appreciated that the present invention can take many forms and embodiments. The true essence and spirit of this invention are defined in the appended claims, and it is not intended that the embodiment of the invention presented herein should limit the scope thereof.

What is claimed is:

1. An improved reversing weight assembly for a vibratory bowl finishing machine comprising:

a vibratory bowl finishing machine including a lower vertical drive shaft operatively connected to a power means, the drive shaft having top and bottom ends;

a lower eccentric weight fixed to the lower vertical drive shaft, the drive shaft extending upwardly through bearing means which are connected to a resiliently-mounted vibratory bowl;

a reversing weight assembly fixedly mounted to the top end of the lower vertical drive shaft including a dampener housing having a bottom flange means for fixable mounting to the lower vertical drive shaft, a middle enclosed cavity, and an upper flange, a top vertical shaft extending from within the cavity upwardly through a bushing associated with the top flange to an exposed upper end, a dampener vane attached to the top vertical shaft inside the cavity, an upper eccentric weight fixedly attached to the upper end of the top vertical shaft and extending laterally along the top of the top flange, end limit stops positioned on the top of the top flange restricting the range of movement of the top eccentric weight there between, the cavity of the housing containing dampening material; and the top eccentric weight moving from one end stop the other upon reversal of the lower drive shaft in reaction to the centrifugal force of the dampening material on the vane and of the housing, with the dampening material dampening any forcible reaction to reversal of direction.

2. An improved vibratory bowl machine comprising:

base means;

motor means;

bowl means resiliently mounted to the base means;

drive shaft means rotatable in opposite direction by the motor means extending through bearing means connected to the bowl means;

lower eccentric weight means fixedly attached to the drive shaft means, the lower eccentric weight means having a center of gravity extending laterally from a rotational axis defined by the longitudinal axis of the drive shaft means;

upper eccentric weight mean having a center of gravity extending laterally outwardly from the rotational axis;

upper shaft means to which the upper eccentric weight is fixedly attached, the upper shaft means extending generally along the rotational axis;

dampener means associated with the upper eccentric weight means positioned intermediately between the drive shaft and the upper shaft means;

the dampener means having a housing fixedly attached to the drive shaft means and directly rotatable with the drive shaft means;

a dampener vane positioned inside the housing means, the dampener vane rotatable with the upper shaft means and upper eccentric weight means;

dampening fluid contained within the housing means; and stop limit means mounted on the housing define the range of pivotal rotation for the upper eccentric weight with respect to the housing.

3. A method for improved reversing of a vibratory bowl finishing machine comprising:

connecting an upper eccentric weight to a freely rotatable member;

positioning a stop means at positions for desired trailing angles for clockwise and counterclockwise rotation of a drive shaft for the machine;

connecting a container filled with dampening medium to the drive shaft so that it is rotatable with the drive shaft; and dampening any shift of position of the upper eccentric weight between stop means by absorbing any shock or forces with the dampening medium.

4. An improved reversing weight assembly for a vibratory bowl finishing machine comprising:

a housing attached to and rotatable with a drive shaft;

the housing having a lower plate, upper plate, and an enclosing sidewall there between;

a dampening vane freely rotatable inside the housing;

connecting means between the vane and a top eccentric weight positioned outside the housing; and stop means associated with the housing adjustably positionable to determine opposite limits of rotation of the upper eccentric weight to determine trailing angles for rotation of the drive shaft in either direction.

* * * * *